United States Patent [19]

Davis

[11] 4,004,549

[45] Jan. 25, 1977

[54] ROLL FUSER

[75] Inventor: Miles Davis, Rochester, N.Y.

[73] Assignee: Xerox Corporation, Stamford, Conn.

[22] Filed: Nov. 10, 1975

[21] Appl. No.: 630,378

[52] U.S. Cl. ..... 118/60; 432/60

[51] Int. Cl.[2] ..... B05C 11/00

[58] Field of Search ..... 118/60, 203, 637, DIG. 15; 432/60, 228

[56] References Cited

UNITED STATES PATENTS

| | | | |
|---|---|---|---|
| 2,217,552 | 10/1940 | Horton | 118/DIG. 15 |
| 3,718,116 | 2/1973 | Thettu | 118/60 X |
| 3,883,291 | 5/1975 | Cloutier et al. | 432/60 |

FOREIGN PATENTS OR APPLICATIONS

| | | | |
|---|---|---|---|
| 779,674 | 7/1957 | United Kingdom | 118/DIG. 15 |

*Primary Examiner*—Louis K. Rimrodt

[57] ABSTRACT

A roll fusing apparatus comprising a heated roll structure and a resilient backup roll cooperating with the heated roll structure to form a nip through which toner images as with the toner images contacting the heated fuser roll structure. The heated fuser roll structure comprises a rigid core and an elastomeric outer layer, the outer surface of the rigid core and the inner surface of the elastomeric layer having non-uniform cross sections which are complementary one to the other to thereby provide alternately thick and thin segments or portions of elastomeric material wherein the thick portions provide for a greater capacity of release agent material than the thin portions while the thin portions provide a minimal barrier to heat transfer from within the heated fuser structure to the external surface of the elastomeric layer.

6 Claims, 3 Drawing Figures

ROLL FUSER

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well-known.

One approach to thermal fusing of electroscopic toner images onto a support has been to pass the support with the toner images thereon between a pair of opposed roller members, at least one of which is either externally or internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transfer to the toner, virtually no offset of the toner particles from the copy sheet to fuser roll is experienced under normal conditions. This is because the heat applied to the surface of the roller is insufficient to raise the temperature of the surface of the roller above the hot offset temperature of the toner whereat the toner particles in the image areas of the toner would liquefy and cause a shearing action in the molten toner to thereby result in "hot offset". Shearing occurs when the inter-particle forces holding the viscous toner mass together is less than the surface energy forces tending to offset it to a contacting surface such as the fuser roll. Further, by the provision of the proper roll surface material, therefore, abhesive materials, offset of toner particles is minimized.

Occasionally, however, toner particles will be offset to the fuser roll by an insufficient application of heat to the surface thereof (i.e., "cold offsetting") by imperfections in the properties of the entire surface of the roll; or by the toner particles insufficiently adhereing to the copy sheet by the electrostatic forces which normally hold them there. In such a case, toner particles may be transferred to the surface of the fuser roll with subsequent transfer to the backup roll during periods of time when no copy paper is in the nip and before the backup roll can be moved out of contact with the fuser roll.

Moreover, toner particles can be picked up by the fuser and/or backup roll during fusing of duplex copies or simply from the surroundings of the reproducing apparatus.

It will be appreciated that in order to prevent such toner particles being transferred to the copy paper, it is necessary to remove the toner particles from the fuser roll and/or the backup roll. It will be further appreciated that if enough toner accumulates on the fuser and/or backup roll, the paper feed through the fusing system will be adversely affected.

One arrangement for minimizing the foregoing problems, including that which is commonly referred to as "offsetting", has been to provide a fuser roll with an outer surface or covering of polytetrafluoroethylene commonly known as Teflon, to which a release agent such as silicone oil is applied. Silicone based oils, which possess a relatively low surface energy, have been found to be a material that is suitable for use in the heated roll fuser environment. In practice, a thin layer of silicone oil is applied to the surface of the heated roll to thereby form an interface between the roll surface and the toner images carried on the support material. Thus, a low surface energy layer is presented to the toner as it passes through the fuser nip and thereby prevents toner from adhering or offsetting to the fuser roll surface.

Another arrangement for minimizing the aforementioned "offsetting" problem is to provide a fuser member, for example, a fuser roll or belt structure with an outer surface or layer of silicone rubber which due to its elastic properties during operation, prevents toner offset thereto. The foregoing is disclosed in U.S. Pat. No. 3,666,247 issued May 30, 1972 wherein it is stated that "while the toner is still in a molten state and when the deformed elastomer is in the process of returning to its original shape, it separates from the toner thereby setting up a shear force which prevents the toner from offsetting to the heated element".

While it may be desirable to completely avoid the employment of release material from the standpoint of overall cost of operation of the apparatus, utilizing a contact fuser having a conformable surface such as silicone rubber which has a continuous supply of silicone oil provided therefor has been found to yield superior results in preventing toner offsetting accompanied by a considerable cost savings and very wide latitude in operation. Systems are known which apply silicone oil to a silicone rubber surface wherein i.e., U.S. Pats. Nos. 3,716,221 and 3,731,358, however, only in an intermittent fashion which is adequate for low volume and light density image applications. Low volume refers to fewer images rather than fewer copies.

While U.S. Pat. No. 3,731,358 may be considered for its disclosed application as being a continuous silicone oil system it has been determined that the capacity of such a system is quite limited. Such limitation being attributable to the relative restrictions imposed upon the thickness of the silicone rubber employed as the outer surface of that fuser construction due to the fact that silicone rubber severely retards the flow of thermal energy from within the fuser roll structure to without.

Accordingly, it is a primary object of this invention to provide a new and improved fuser apparatus.

Another object of this invention is to provide an improved fuser apparatus wherein a release material is continuously applied to the surface of a fuser roll structure having an elastomeric surface wherein the release material is impregnated in the elastomeric surface.

Still another object of this invention is to provide a silicone rubber surfaced fuser roll structure having increased capacity of release agent material for coating the surface thereof to prevent offset of toner and to facilitate stripping of copy paper therefrom.

Other objects and advantages of the invention will become apparent from the detailed description of the invention when read in conjunction with the accompanying drawings.

DETAILED DESCRIPTION OF THE INVENTION

Figure 1:
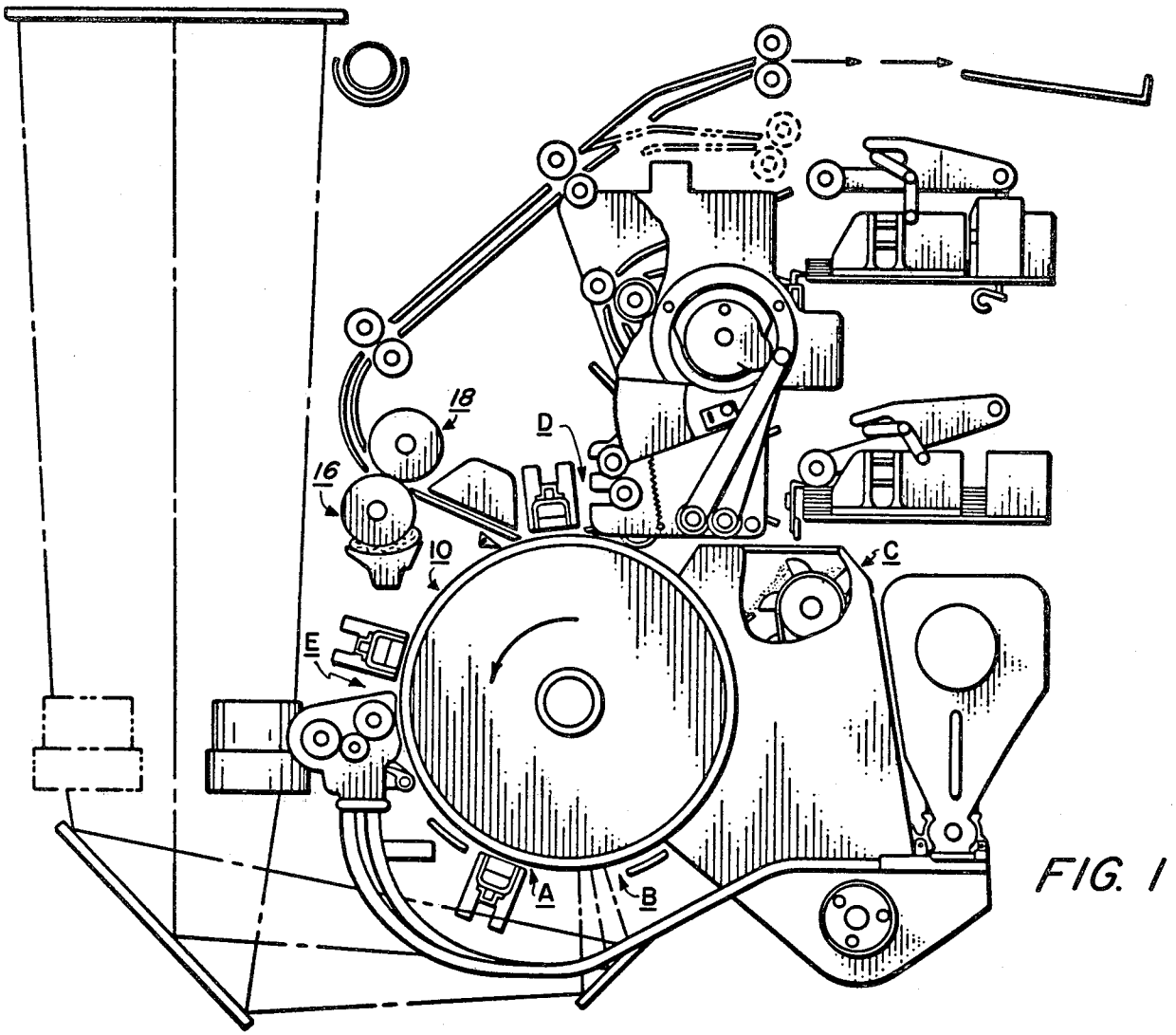
FIG. 1 is a schematic representation of an automatic xerographic reproducing machine incorporating the heated roll fuser apparatus.

Referring now to the drawings as shown in FIG. 1, an embodiment of the invention in a suitable environment such as an automatic xerographic reproducing machine is illustrated. The automatic xerographic reproducing machine includes a xerographic plate or surface 10 formed in the shape of a drum. The plate has a photoconductive layer or light sensitive surface on a conductive backing journaled in a frame to rotate in a direction indicated by the arrow. The rotation will cause the plate surface to sequentially pass a series of xerographic processing stations.

For purposes of the present disclosure, the several xerographic processing stations in the path of movement of the plate surface may be described functionally as follows:

- A charging station A at which the photoconductive plate is uniformly charged;
- An exposure station B at which light or radiation patterns of originals to be reproduced are projected onto the plate surface to dissipate the uniform charge in accordance with the patterns to thereby form latent electrostatic images of the originals to be reproduced;
- A developing station C at which xerographic developing material including toner particles having electrostatic charges opposite to that of the latent electrostatic images is cascaded over the latent electrostatic image to form powder images in accordance with the original being reproduced;
- A transfer station D at which the powder images are electrostatically transferred from the plate surface to a transfer material such as paper which is then passed through a heat pressure fusing system according to the present invention as will be described hereinafter; and
- A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon.

For further details of the xerographic processing stations reference may be had to U.S. Pat. No. 3,578,859, filed July 3, 1969 and issued in the name of W. K. Stillings.

Figure 2:
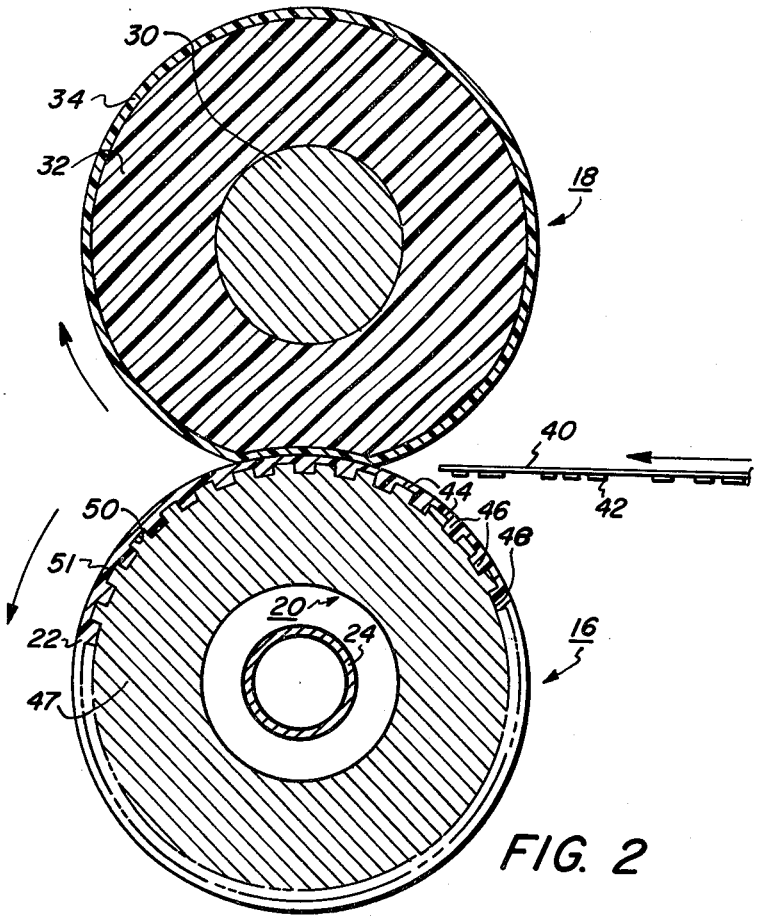
FIG. 2 is a side elevational view, in cross section, of the roll fusing apparatus incorporated in FIG. 1.

As illustrated in FIG. 2, the heated pressure fusing system of the present invention includes a heated fuser roll 16 and a backup roll 18. The fuser roll 16 comprises a hollow cylinder with a metallic core 20 and a suitable elastomer layer 22 supported thereon. Typical materials for the layer 22 are fluorocarbon, fluorosilicone and polysiloxane rubbers commercially available as Viton a trademark of Dupont, Dow Corning RTV 733, Dow Corning 94003, and General Electric RTV 112. A lamp 24 serves as a source of thermal energy and is located at the center of the fuser roll. Power to the lamp is controlled by a thermal sensor, for example, a thermistor (not shown) contacting the periphery of the fuser roll as described, for example, in U.S. Pat. No. 3,357,249.

The backup roll 18 is also a cylindrical member and is made up of a metal core 30 surrounded by a thick rubber layer 32 and a Teflon layer 34.

When the two rollers 16 and 18 are engaged as shown in FIG. 2, with a load applied thereto, the rubber on the pressure roll 18 deforms to provide a nip with a finite length. A copy sheet 40 electrostatically bearing toner image 42 on one side thereof is moved through the nip with the toner images contacting the fuser roll 16. For a given temperature of the fuser roll, fusing of the toner images will be a function of the "dwell time" which is proportional to the ratio of the nip length to surface speed. Accordingly, it can be seen that the dwell time can be varied by either changing the velocity of the rolls or varying the nip length or a combination of both. The nip length depends on the softness of the thick rubber layer 32 on the backup roll 18 and the amount of pressure exerted between the rolls 16 and 18. The mechanism for driving the rolls and for lowering and raising the rolls into and out of contact can be accomplished by any suitable means such as that described in U.S. Pat. No. 3,291,466 or by a suitable mechanical camming device.

As a sheet of material 40 is advanced between the rolls 16 and 18, the toner image on the support material will contact the peripheral heated surface of the roll 16 whereby the toner image under normal operating conditions, becomes tackified. However, under certain other conditions as outlined above, toner will tend to offset on the roll except that it is partially prevented from doing so by the silicone rubber layer 22.

As illustrated in FIG. 2, the rigid core structure 20 has a non-uniform cross section adjacent the outer surface thereof delineated by lands 44 having recesses 46 disposed intermediate thereof, the lands being connected by a base portion 47. The lands are on the order of 0.005 inch wide and approximately 0.010 high.

The elastomeric or silicone rubber layer 22 is also provided with a non-uniform cross section adjacent the inner surface thereof which cross section is delineated by lands 48 which are received in the recesses 46 and recesses 50 are formed between the lands 48 and receive the lands 44 of the core 20, the lands 48 being connected by a base portion 51 facing the outer surface of the layer 22. The lands and recesses of the layer 22 like the lands and recesses of the core 20 are of approximately the same dimensions and are as will be appreciated equal to those of the lands and recesses of the core 20. The resulting construction provides an elastomeric surface which has alternate thick and thin segments of porous rubber material. The thicker segments delineated by the lands 48 are suitable for acting as a reservoir for silicone oil impregnated in the silicone rubber. It will be appreciated that the thin portions of the silicone rubber provide a minimal barrier to the flow of thermal energy from the internal heat source 24.

Alternately, in lieu of impregnating the silicone rubber with silicone oil the silicone rubber may be provided with a catalyst material which accelerates the degradation of the rubber at elevated temperatures and in the presence of moisture to thereby convert the cross linked silicone rubber into silicone oil which would be available for forming a barrier coating on the surface of the elastomeric layer which coating would minimize offset toner to the surface thereof and would also facilitate stripping of copy paper having toner images thereon from the roll surface.

Figure 3:
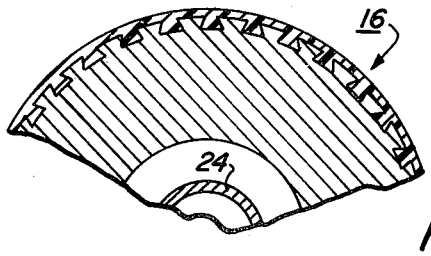
FIG. 3 is an enlarged fragmentary cross-sectional view of a modified form of the fuser roll structure of the FIG. 2.

As disclosed in FIG. 3, the cross-sectional non-uniformity adjacent the outer surface of the metal core and the inner surface of the silicone rubber layer may have various configurations as depicted by the shape of lands 52 delineating recesses 54 and lannds 56 delineating recesses 56.

While the invention has been described in conjunction with the preferred embodiments, it will be appreciated that various modifications will occur to those skilled in the art and it is intended that such modifications be covered by the claims appended hereto.

What is claimed is:

1. Roll fuser apparatus for fixing toner images to support material including a heated fuser structure and a resilient backup member cooperating with said heated fuser structure to form a nip through which said support material passes with the toner images carried thereby contacting the heated fuser structure wherein:

said heated fuser structure comprises a rigid conductive core;

an elastomeric layer affixed to the outer surface of said rigid core and impregnated with release agent material;

means disposed internally of said rigid core for elevating the temperature of the surface of said elastomeric layer to a degree sufficient for softening toner of said toner images; and said rigid core having a non-uniform cross section adjacent its outer surface and said elastomeric layer having a non-uniform cross section adjacent its inner surface, said non-uniform cross sections being complementary one to the other whereby said elastomeric layer comprises alternately thick and thin portions wherein the thick portions are adapted to provide a greater quantity of release agent material than the thin portions and the thin portions are sufficiently thin to provide minimal impedance to thermal energy flowing from within said core to the outer surface of said elastomeric layer.

2. Apparatus according to claim 1 wherein said fuser structure and said backup member have a generally cylindrical configuration.

3. Apparatus according to claim 2 wherein said elastomeric layer comprises silicone rubber.

4. Apparatus according to claim 3 wherein said rigid core is fabricated from a material having a high degree of thermal conductivity.

5. Apparatus according to claim 4 wherein said release agent material comprises silicone oil.

6. Apparatus according to claim 5 wherein said thick and thin portions extend along the longitudinal axis of said elastomeric layer.

* * * * *